US010829131B2

(12) United States Patent
Sutterluety et al.

(10) Patent No.: US 10,829,131 B2
(45) Date of Patent: Nov. 10, 2020

(54) DEVICE FOR LOCKING A PIVOTAL PROTECTIVE DEVICE FOR A CHAIRLIFT

(71) Applicant: INNOVA PATENT GMBH, Wolfurt (AT)

(72) Inventors: Andreas Sutterluety, Egg (AT); Dominik Fink, Dornbirn (AT)

(73) Assignee: Innova Patent GmbH, Wolfurt (AT)

( * ) Notice: Subject to any disclaimer, the term of this patent is extended or adjusted under 35 U.S.C. 154(b) by 503 days.

(21) Appl. No.: 15/563,746

(22) PCT Filed: Feb. 29, 2016

(86) PCT No.: PCT/AT2016/000020
§ 371 (c)(1),
(2) Date: Oct. 2, 2017

(87) PCT Pub. No.: WO2016/154643
PCT Pub. Date: Oct. 6, 2016

(65) Prior Publication Data

US 2018/0087300 A1 Mar. 29, 2018

(30) Foreign Application Priority Data

Apr. 2, 2015 (AT) ..... A201/2015

(51) Int. Cl.
*B61B 12/06* (2006.01)
*B61B 12/00* (2006.01)
*E05C 3/00* (2006.01)
*E05C 3/04* (2006.01)

(52) U.S. Cl.
CPC ..... *B61B 12/06* (2013.01); *B61B 12/002* (2013.01); *E05C 3/004* (2013.01); *E05C 3/042* (2013.01)

(58) Field of Classification Search
CPC ..... B61B 12/002; B61B 12/06; E05C 3/004; E05C 3/042
USPC ..... 105/149.2
See application file for complete search history.

(56) References Cited

U.S. PATENT DOCUMENTS 2,662,587 A * 12/1953 McIlvaine ..... B61B 12/002 297/411.32
2,985,224 A * 5/1961 Sowder ..... B61B 12/002 297/184.12
3,008,761 A * 11/1961 McIlvaine ..... B61B 12/002 297/84

(Continued)

FOREIGN PATENT DOCUMENTS

CH 704867 A2 10/2012
DE 202011003078 U1 6/2011

(Continued)

*Primary Examiner* — Zachary L Kuhfuss
(74) *Attorney, Agent, or Firm* — Laurence A. Greenberg; Werner H. Stemer; Ralph E. Locher

(57) ABSTRACT

A device for locking a pivotal protective device, such as a safety bracket or a weather protection hood, of a chair for a chairlift. The device has interacting projections, one of which is connected to a frame of the chair and the other of which is connected to the protective device. At least one of the projections is resiliently mounted, and the projections are equipped with sliding surfaces which produce a deformation of the resilient bracket after a defined force has been applied to the safety bracket and allow the projections to slide past one another in both directions.

18 Claims, 4 Drawing Sheets

(56) References Cited

U.S. PATENT DOCUMENTS 3,556,014 A * 1/1971 Rudkin, Jr. ..... B61B 12/002 104/173.2
3,596,612 A * 8/1971 Sowder ..... B61B 12/002 105/149.2
3,747,974 A * 7/1973 Tauzin ..... B61B 12/002 297/184.12
4,303,016 A * 12/1981 Tauzin ..... B61B 12/002 104/173.2
4,630,545 A * 12/1986 Michel ..... B61B 12/002 105/329.1
4,784,065 A * 11/1988 Brochand ..... B61B 12/002 104/173.2
5,213,048 A * 5/1993 Kunczynski ..... B61B 12/002 104/173.2
6,520,573 B2 2/2003 Osterle
6,691,624 B2 * 2/2004 Albrich ..... B61B 12/002 105/149.2
7,377,220 B2 5/2008 Coudurier et al.
7,690,313 B2 * 4/2010 Sutter ..... B61B 12/06 104/117.1
7,984,678 B2 7/2011 Switzeny
8,443,734 B2 * 5/2013 Switzeny ..... B61B 12/002 105/149.1
8,579,379 B2 * 11/2013 Tamisier ..... B61B 12/002 297/487
8,590,458 B2 * 11/2013 Wieser ..... B61B 12/002 105/149.2
9,701,320 B2 * 7/2017 Chedal Bornu ..... B61B 12/002
2002/0043829 A1 * 4/2002 Switzeny ..... B61B 12/002 297/184.12
2018/0087300 A1 * 3/2018 Sutterluety ..... E05C 3/042
2018/0194370 A1 * 7/2018 Sutterluety ..... B61B 12/002
2018/0251137 A1 * 9/2018 Sutterluety ..... B61B 12/002

FOREIGN PATENT DOCUMENTS

DE 102010017068 A1 11/2011
EP 1151903 A2 7/2001
EP 1671867 A1 6/2006
EP 2030858 A2 4/2009
FR 1376569 A 10/1964

* cited by examiner

DEVICE FOR LOCKING A PIVOTAL PROTECTIVE DEVICE FOR A CHAIRLIFT

BACKGROUND OF THE INVENTION

Field of the Invention

The invention relates to an apparatus for locking a pivotable protective device, such as a safety bar, of a chair for a chairlift, having interacting projections, of which one is connected to the frame of the chair and the other is connected to the protective device.

Protective devices of chairlifts, such as safety bars or weather protection hoods for example, if they are situated in the completely open or completely closed end position, have to be held stably in said position, which can take place firstly by way of gravity and secondly assisted by way of springs or locking mechanisms. Unintentional opening or closing of the closing bars is to be suppressed at any rate.

A generally valid setting for the very wide variety of embodiments of chair models, for example with and without a weather protection hood, with or without a locking system and the like, is not possible in practice for many reasons. Reasons of this type are, for example, differences in incline, jolts and vibrations during the journey, different weights, tolerances in production, temperature changes and others of the like.

BRIEF SUMMARY OF THE INVENTION

Therefore, the invention is based on the object of specifying an apparatus, by way of which protective devices are held securely in a defined position and nevertheless can be opened under defined conditions.

Said object is achieved by way of an apparatus having the features which are mentioned at the outset, by virtue of the fact that at least one of the projections is mounted in a sprung manner, and that sliding faces are arranged on the projections, which sliding faces permit the projections to slide past one another in both directions.

If, for example, a safety bar is locked in the closed position, in which it extends transversely over the legs of the passengers and therefore secures them on the chair, by way of the apparatus according to the invention in said end position, the two projections engage behind one another, and the safety bar is held fixedly in this way. If the safety bar is to be opened, the projections have to be moved past one another, it being possible for the force which is required to move the safety bar out of its closed end position into the open position to be set relatively precisely by way of the spring force of the one projection.

It is possible according to the invention that the safety bar is prestressed into the open position by a spring, for example a tension spring, which facilitates the opening of the safety bar as soon as the projections have been moved past one another. Here, the system according to the invention can be set, for example, in such a way that an opening force of from approximately 20 to 30 N acts by way of the tension springs in the closed state of the safety bar. If the safety bar is to be opened only in the case of an additional opening force or a manual force to be applied by the passengers of 30 N, the spring force of the projection has to exert a holding force which corresponds to an overall force of from approximately 50 to 60 N (measured at the front on the safety bar, on which the passengers act).

At the same time, however, the apparatus according to the invention also prevents that the safety bar falls unintentionally into the end position and is held in said end position. If the safety bar is namely moved in the direction of the lower end position by way of vibrations or other forces or, for example, the automatic closure of the weather protection hood (in the case of empty vehicles) which drives the safety bar with it, the apparatus or the projections which come into contact with one another prevents/prevent the completely closed end position from being reached, since the spring force of the one sprung projection is not overcome. As a result, the safety bar can open again automatically or can bear against the closed weather protection hood and can be opened again at the same time as the latter.

Preferred embodiments of the invention are the subject matter of the subclaims.

Further features and advantages of the invention result from the following description of one preferred exemplary embodiment of the invention with reference to the appended drawings, in which:

DESCRIPTION OF THE INVENTION

Figure 1:
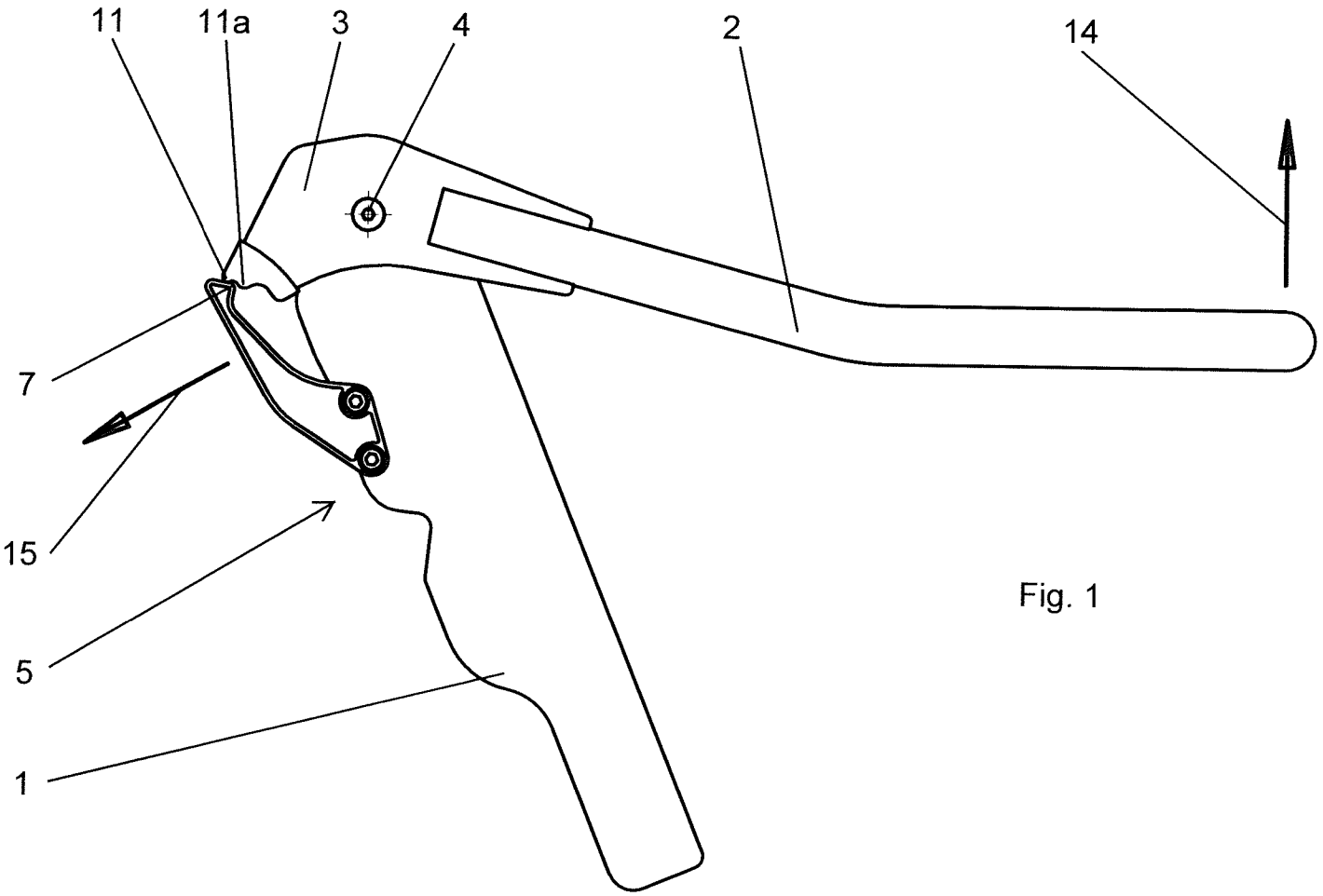
FIG. 1 shows a part of a chair of a chairlift in a side view.

FIG. 1 shows a frame part 1 which is either fastened to the frame of a chairlift or itself forms a part of the frame.

A safety bar 2 is mounted pivotably on the frame part 1, the safety bar 2 having a mounting plate 3 which is mounted on the frame part 1 via a joint 4.

A bracket 5 is fastened to the frame part 1, for example is screwed on the frame part 1 with the aid of bolts 10. The bracket 5 has a spring arm 6, at the end of which a projection 7 is arranged. The projection 7 has two sliding faces 8 and 9, which are oriented in a substantially A-shaped but asymmetrical manner, that is to say in the form of an oblique "A". A further projection 11 is arranged on the mounting plate 3, which further projection 11 for its part has two sliding faces 12 and 13 which are likewise arranged in the form of an oblique "A".

Figure 2:
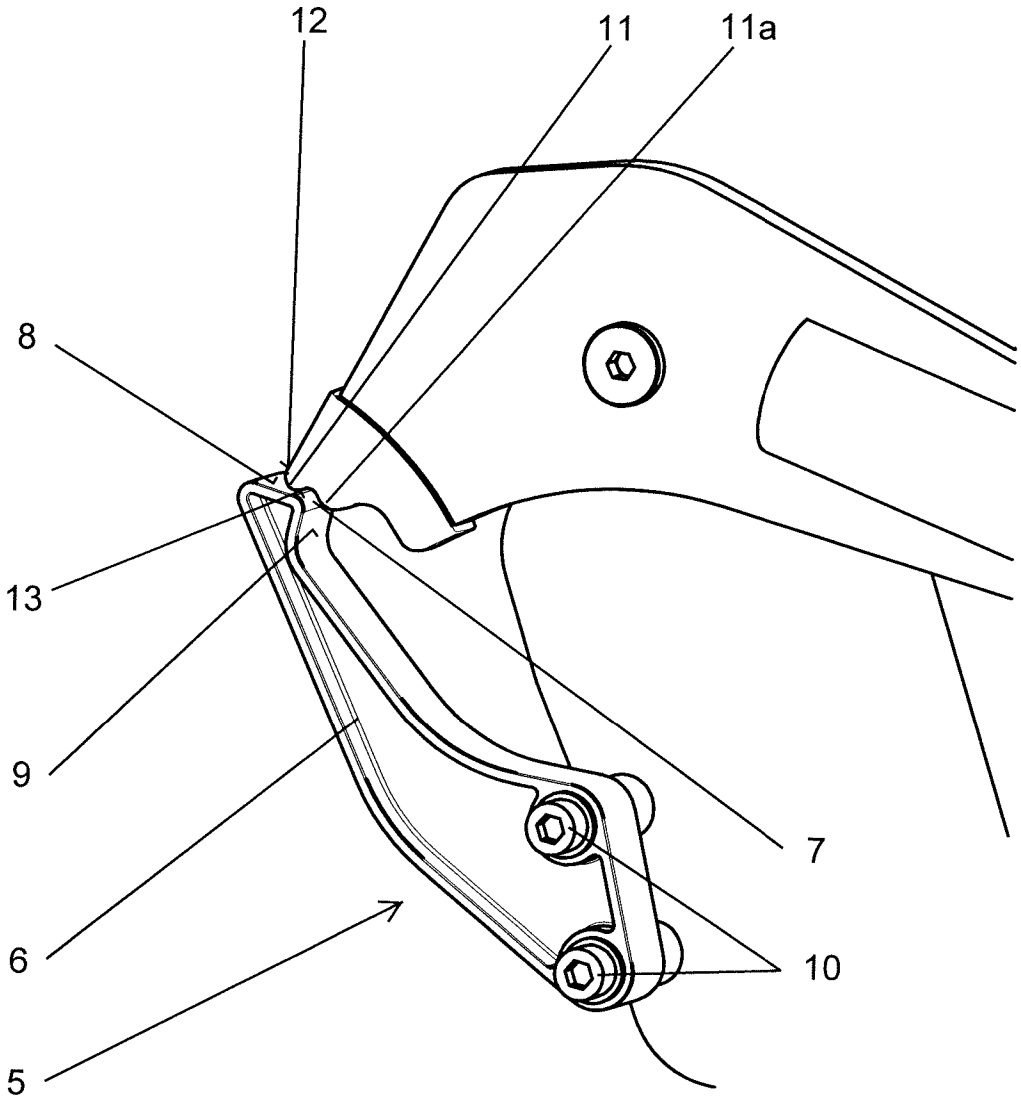
FIG. 2 shows a detail from FIG. 1 in an oblique view on an enlarged scale.
Figure 3:
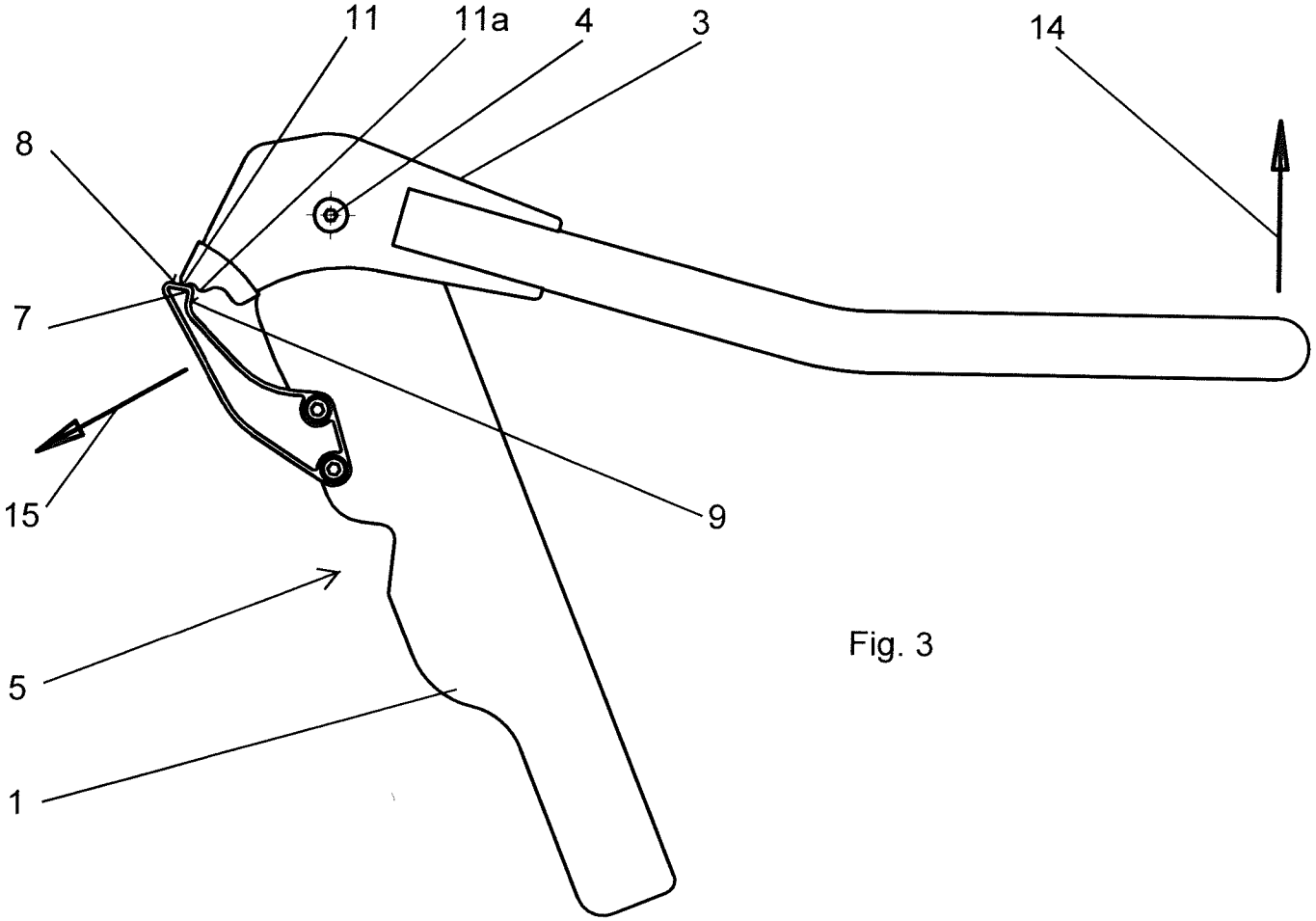
FIG. 3 shows a side view of the apparatus in a locked state.

In the position which is shown in FIGS. 1, 2 and 3, the safety bar 2 is situated in the closed end position, in which it extends transversely over the legs of the passengers. In said position, the projection 11 of the mounting plate 3 bears against the sliding face 8 which is adjacent to the free end of the bracket 5.

In the embodiment which is shown, the spring arm 6 of the bracket 5 has an approximately I-shaped profile, as a result of which said spring arm 6 can provide a great bending resistance moment with a low weight. The bracket 5 is preferably produced from plastic, but can also consist of spring steel or a combination of said or other materials.

In the position which is shown in FIGS. 1 to 3, the sprung bracket 5 is preferably prestressed somewhat, with the result that it presses the safety bar 2 downward into the closed end position. It can also be free from stress in said position, since the safety bar 2 is held in a positively locking manner.

Figure 4:
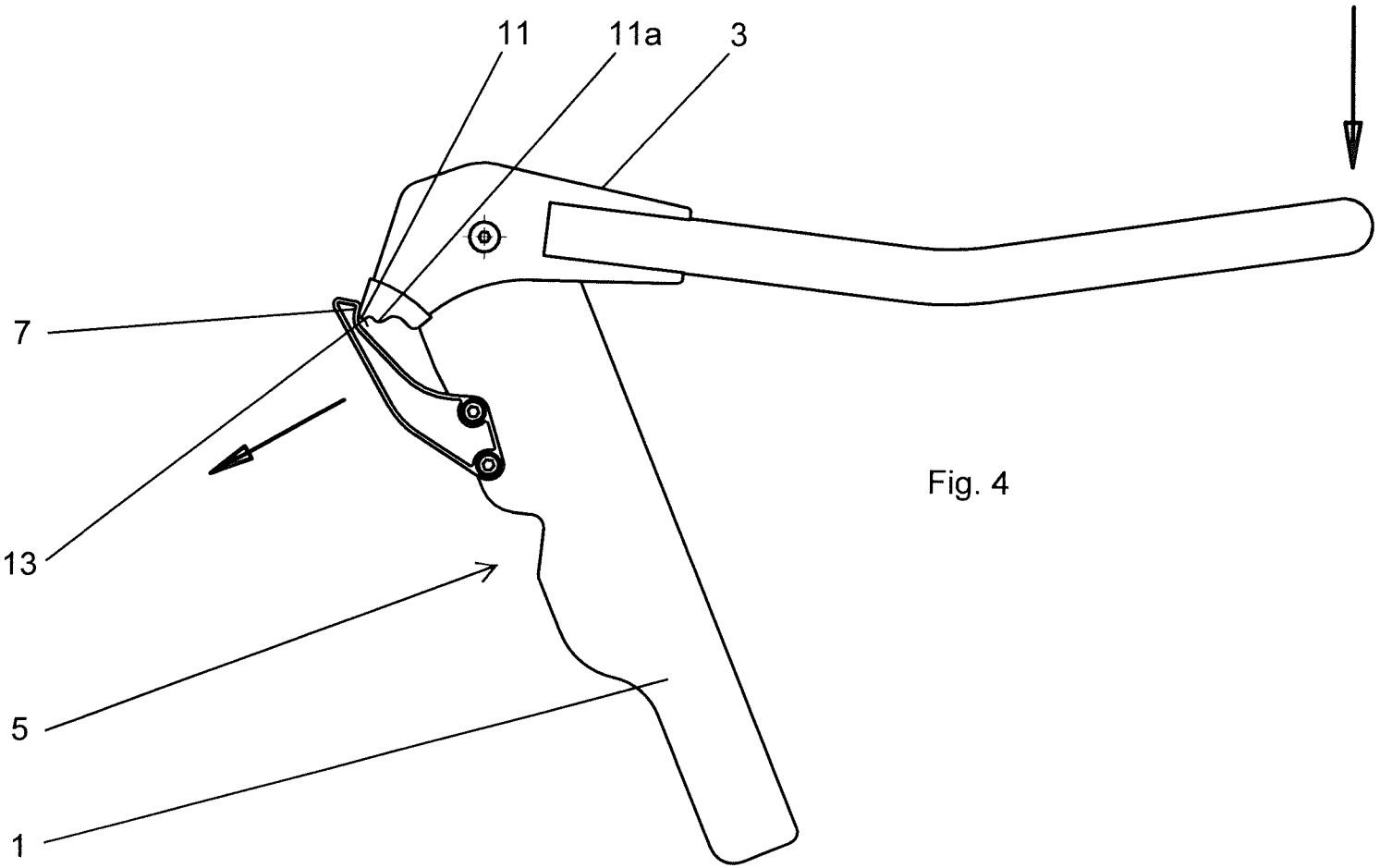
FIG. 4 shows a view in accordance with FIG. 3 in the released state of the apparatus.

If the safety bar 2 is to be opened in the direction of the arrow 14, the sprung bracket 5 has to be pressed away in the direction of the arrow 15 counter to its spring force, the tip of the projection 11 sliding over the sliding face 8 until the projections 7, 11 have been moved past one another, as shown in FIG. 4.

From this time, the safety bar 2 can be moved upward in an unimpeded manner into the other open end position.

If the safety bar 2 is to be closed again, it is first of all moved as far as the position which is shown in FIG. 4, until the projection 11 on the mounting plate 3 comes into contact with the sliding face 9 on the sprung bracket 5. From this time, the spring force of the sprung bracket 5 has to be overcome for a further closing movement, until the safety bar 2 or its mounting plate 3 has again reached the position which is shown in FIGS. 1 to 3.

Unintentional closure of the safety bar 2 can be prevented by way of the force which has to be applied to or by way of the safety bar 2 during the closure, in order that the spring force of the bracket 5 is overcome, with the result that said safety bar 2 can again be moved upward in an unimpeded manner and no operational disruptions can occur on account of an absence of freedoms of movement while the chair is moving through the station.

The apparatus according to the invention is particularly preferably used in chairs of chairlifts which have a spring, for example a tension spring, which automatically moves the safety bar 2 into the open position, in order to compensate for the weight of the safety bar 2. According to the invention, said spring force can be greater than that which would be necessary for compensating for the weight of the safety bar 2, since the safety bar 2 is held actively in the closed end position by way of the bracket 5.

As a further consequence, this makes it possible for a defined force system to be built up, in which external forces which act on the chair and the safety bar 2, for example wind forces, vibrations and the like, are counteracted in an over-compensated manner, whereby unstable force equilibria can be avoided which can lead to movements or positions of the protective device which can in part be undesired and in part can even be contrary to regulations.

By way of the apparatus according to the invention, furthermore, a relatively precise holding force of the safety bar 2 can be set, which holding force has to be overcome in order to open the safety bar 2, the safety bar 2 then independently opening in an automatic manner as a further consequence, assisted by the abovementioned spring force.

Instead of the sprung bracket 5 which is shown in the figures, other measures can also be taken, in order that at least one of the two projections 7, 11 can yield in a sprung manner. For example, a lever with a projection would be conceivable, the lever being pivotable counter to the force of a tension or else compression spring or torsion spring, a rubber/metal bush, a polymer element or the like. It would likewise be conceivable, for example, to hold a ball or a pin in a bore such that it can be displaced counter to a spring.

In the drawings, a further projection 11*a* is optionally illustrated in addition to the projection 11 on the mounting plate 3, which further projection 11*a* forms a second locking stage for the safety bar 2. Accordingly, during closure, the safety bar 2 is first of all locked by way of the projection 11 and, in the further course, is locked finally in its end position by way of the projection 11*a*. It goes without saying that the second projection 11*a* does not have to be present or that a further projection might be present on the bracket 5.

In summary, one exemplary embodiment of the invention can be described as follows:

An apparatus for locking a pivotable protective device, such as a safety bar 2 or a weather protection hood, of a chair for a chairlift, has interacting projections 7, 11, 11*a*, of which one is connected to a frame of the chair and the other is connected to the protective device. At least one of the projections 7 is mounted in a sprung manner, and sliding faces 8, 9; 12, 13 are arranged on the projections 7, 11, 11*a*, which sliding faces 8, 9; 12, 13, after a defined force is applied on the safety bar 2, bring about a deformation of the sprung bracket 5 and permit the projections 7, 11, 11*a* to slide past one another in both directions.

The invention claimed is:

1. An apparatus for fixing a pivotable protective device of a chair for a chairlift, the apparatus comprising:

a first projection connected to a frame of the chair and a second projection connected to the protective device and disposed to interact with said first projection when the protective device is pivoted;

wherein at least one of said first and second projections is mounted in a sprung manner; and said first and second projections each being formed with respective sliding faces configured to permit said projections to slide past one another in both directions.

2. The apparatus according to claim 1, wherein the protective device is a safety bar or a weather protection hood.

3. The apparatus according to claim 1, which comprises a sprung bracket having said at least one projection mounted thereon in a sprung manner.

4. The apparatus according to claim 3, wherein said sprung bracket is connected to the frame of the chair.

5. The apparatus according to claim 3, wherein said sprung bracket consists of plastic or of spring steel.

6. The apparatus according to claim 3, wherein said sprung bracket has a spring arm with an L-shaped cross section.

7. The apparatus according to claim 1, wherein said sliding faces of at least one of said projections are arranged asymmetrically.

8. The apparatus according to claim 7, wherein both said first and second projections are arranged asymmetrically.

9. The apparatus according to claim 1, which comprises a mounting plate disposed on the protective device and pivotally mounting the protective device on the frame, and wherein a respective said projection is arranged on said mounting plate.

10. The apparatus according to claim 1, wherein said at least one projection that is mounted in a sprung manner is mounted to be pivoted or displaced counter to a force of a spring.

11. The apparatus according to claim 1, wherein said first and second projections interact in an end position of the protective device.

12. The apparatus according to claim 11, wherein said first and second projections are disposed to interact in a closed position of the protective device.

13. The apparatus according to claim 1, which comprises a spring disposed to bias the protective device out of an end position in a direction of another end position, and wherein a force of said spring is smaller than a holding force of said first and second, mutually interacting projections.

14. The apparatus according to claim 9, wherein two said projections are disposed next to one another on said mounting plate.

15. A chair for a chairlift, the chair comprising a pivotable protective device and an apparatus according to claim 1 for arresting said pivotable protective device.

16. A cableway system, comprising at least two stations, a cable extending between said stations, and a plurality of chairs to be connected to said cable and to be moved between said stations, wherein said chairs each carry an apparatus according to claim 1.

17. An apparatus for fixing a pivotable protective device of a chair for a chairlift, the apparatus comprising:

a first projection connected to a frame of the chair and a second projection connected to the protective device and disposed to interact with said first projection when the protective device is pivoted;

wherein at least one of said first and second projections is mounted in a sprung manner; and said first and second projections being formed with sliding faces configured to permit said projections to slide past one another in both directions, at least one of said projections having said sliding faces inclined in an A-shape with respect to one another.

18. The apparatus according to claim 17, wherein both said first and second projections are formed with sliding faces inclined in an A-shape.

* * * * *